US007826789B2

(12) United States Patent
Nord

(10) Patent No.: US 7,826,789 B2
(45) Date of Patent: Nov. 2, 2010

(54) SYSTEM AND METHOD FOR INTERACTIVE BROADCASTING

(75) Inventor: Lars B. Nord, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 854 days.

(21) Appl. No.: 11/620,937

(22) Filed: Jan. 8, 2007

(65) Prior Publication Data

US 2008/0166963 A1 Jul. 10, 2008

(51) Int. Cl.
*H04H 20/71* (2008.01)

(52) U.S. Cl. ..... 455/3.01; 455/3.06; 709/231

(58) Field of Classification Search ..... 455/3.01–3.06; 725/62–85; 709/230–231
See application file for complete search history.

(56) References Cited

U.S. PATENT DOCUMENTS

| | | | | |
|---|---|---|---|---|
| 6,957,041 | B2 * | 10/2005 | Christensen et al. | 455/3.06 |
| 7,031,734 | B2 * | 4/2006 | Kim | 455/466 |
| 7,096,115 | B1 | 8/2006 | Groth et al. | |
| 2003/0114224 | A1 * | 6/2003 | Anttila et al. | 463/40 |
| 2003/0224810 | A1 * | 12/2003 | Enzmann et al. | 455/466 |
| 2007/0226367 | A1 * | 9/2007 | Cai et al. | 709/238 |
| 2007/0299681 | A1 * | 12/2007 | Plastina et al. | 705/1 |
| 2008/0085682 | A1 * | 4/2008 | Rao | 455/74 |

FOREIGN PATENT DOCUMENTS

| | | |
|---|---|---|
| CN | 1582029 | 2/2005 |
| WO | 03001474 | 1/2003 |
| WO | 2004049607 | 10/2004 |

OTHER PUBLICATIONS

International Search Report and Written Opinion from corresponding International Application No. PCT/IB07/001828.
International Preliminary Report on Patentability from corresponding International Application No. PCT/IB07/001828.

* cited by examiner

*Primary Examiner*—Raymond S Dean
(74) *Attorney, Agent, or Firm*—Renner, Otto, Boisselle & Sklar, LLP

(57) ABSTRACT

A method of interactive broadcasting may include transmitting a broadcast with a broadcast transceiver associated with a broadcast transmitting electronic device. The broadcast is intended for reception by one or more broadcast receiving electronic devices. A message may be received from one of the broadcast receiving electronic devices and the message may be added to the broadcast.

18 Claims, 4 Drawing Sheets

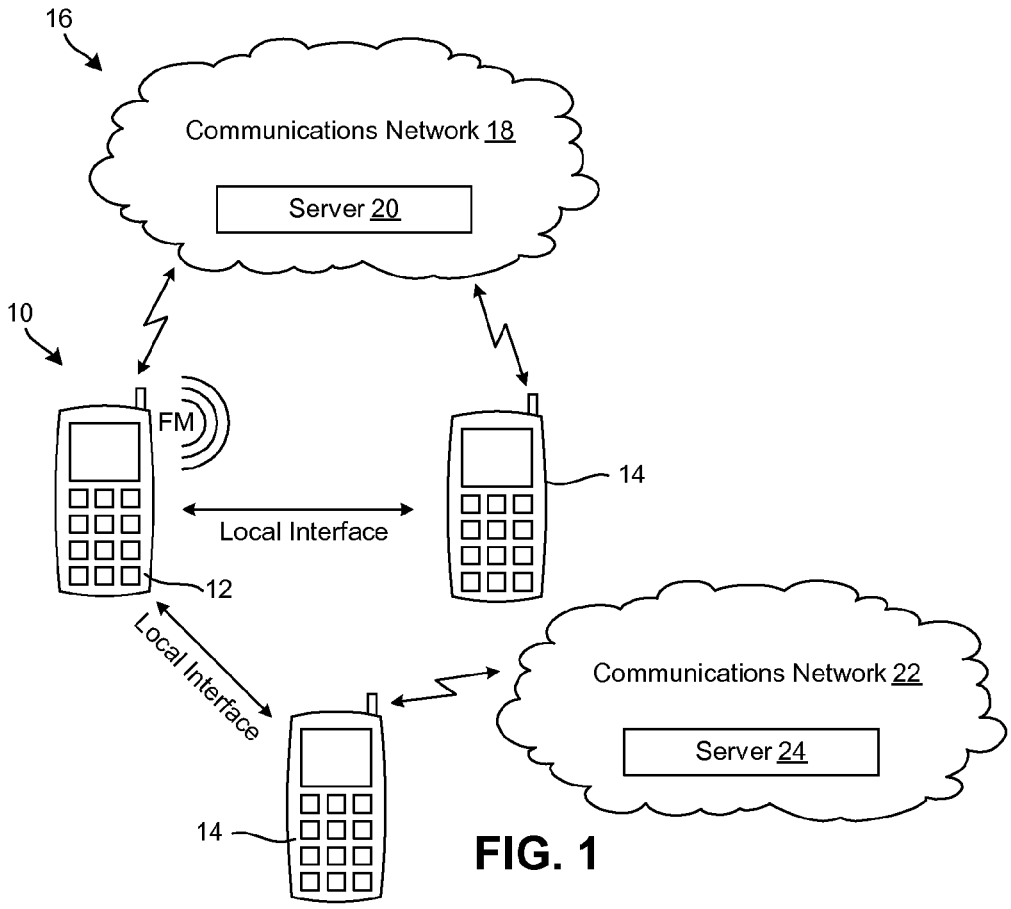
FIG. 1
FIG. 2
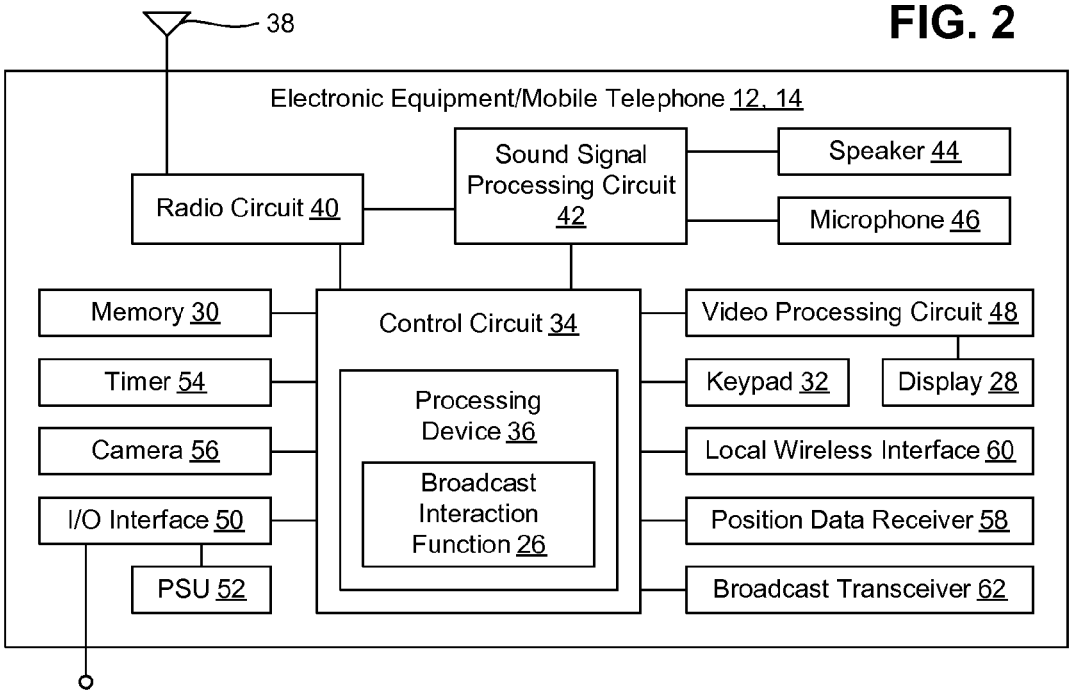

SYSTEM AND METHOD FOR INTERACTIVE BROADCASTING

TECHNICAL FIELD OF THE INVENTION

The present invention relates generally to broadcasting, such as FM broadcasting in accordance with radio data system (RDS). More particularly, the invention relates to a system and method for establishing an interactive commentary or discussion platform among a person or persons tuned to the broadcast and a person generating the broadcast.

DESCRIPTION OF THE RELATED ART

Mobile and/or wireless electronic devices are becoming increasingly popular. For example, mobile telephones, portable media players and portable gaming devices are now in wide-spread use. In addition, the features associated with certain types of electronic devices have become increasingly diverse. To name a few examples, many electronic devices have cameras, text messaging capability, Internet browsing capability, electronic mail capability, video playback capability, audio playback capability, image display capability and handsfree headset interfaces.

In addition, it is now possible for individuals to broadcast data using a frequency modulated (FM) radio broadcast technique. For example, the user of a mobile telephone, media player or computer may use a frequency modulation (FM) radio transmitter accessory to broadcast music, speech, or other content for reception by FM receivers that are located within a transmission range of the transmitter. Current transmitters of this kind typically have a range of about twenty to thirty meters and operate under an accepted broadcast standard. One such standard is radio data system (RDS) from the European Broadcasting Union. RDS is a standard for sending digital information using a conventional FM radio broadcast. RDS standardizes data transmission formats and the transmission of time data and station identification. In the United States, a similar system is radio broadcast data system (RBDS). RBDS is so similar to RDS and is so often referred to as RDS (instead of RBDS) that the term RDS, as used herein, is intended to include the European standard, the U.S. standard and another other similar approach to radio broadcasting. It will be understood that radio broadcasts are not addressed to any particular device and may be received by any compatible receiver within the transmission range of the transmitter that generates the radio signal.

Persons that share common interests for certain types of content (e.g., news, sports, music genres, etc.) often like to share their thoughts. To share those thoughts music communities and other communities exist over platforms such as the Internet. Within those communities individuals may share thoughts by posting text messages, uploading photographs and uploading video, for example.

SUMMARY

To enhance the ability to share content with others and establish a communication platform to share thoughts regarding the content and/or other subjects, there is a need in the art for a system and method for establishing an interactive broadcasting platform. One such platform may involve the broadcasting of content using, for example, an FM transmission under radio data system (RDS) and receiving addressed messages from devices tuned to the broadcast. The received messages may be broadcast over the FM transmission for wider distribution. Also, addressed messages may be sent in reply to received messages.

According to one aspect of the invention, a method of interactive broadcasting includes transmitting a broadcast with a broadcast transceiver associated with a broadcast transmitting electronic device, the broadcast for reception by one or more broadcast receiving electronic devices; receiving a message from one of the broadcast receiving electronic devices; and adding the message to the broadcast.

According to one embodiment of the method, the message is a text message.

According to one embodiment of the method, the message is pushed to the broadcast transmitting electronic device.

According to one embodiment of the method, the message is addressed to the broadcast transmitting electronic device.

According to one embodiment, the method further includes sending a reply message that is addressed to the broadcast receiving electronic device that is the source of the message.

According to one embodiment of the method, the message is delivered via a network.

According to one embodiment of the method, the message is delivered via a local interface established directly between the broadcast transmitting electronic device and the broadcast receiving electronic device.

According to one embodiment of the method, the broadcast is an FM broadcast in accordance with radio data system (RDS).

According to one embodiment of the method, the broadcast transmitting electronic device is a mobile telephone.

According to one embodiment of the method, the broadcast receiving electronic device from which the message is received is a mobile telephone.

According to one embodiment, the method further includes adding a message that is generated by a user of the broadcast transmitting electronic device to the broadcast.

According to one embodiment, the method further includes receiving a message from another one of the broadcast receiving electronic devices and blocking the broadcast of the message and future messages from the another one of the broadcast receiving electronic devices.

According to another aspect of the invention, a method of participating in an interactive broadcast using an electronic device includes receiving a broadcast signal transmitted by a broadcast transmitting electronic device; determining a device address for the broadcast transmitting electronic device; and sending an addressed message to the broadcast transmitting electronic device.

According to one embodiment of the method, the message is a text message.

According to one embodiment of the method, the message is sent over a local interface established directly with the broadcast transmitting electronic device.

According to one embodiment of the method, the electronic device is a mobile telephone.

According to yet another aspect of the invention, an interactive broadcasting system includes a broadcast transceiver for transmitting a broadcast for reception by one or more broadcast receiving electronic devices; a local wireless interface adapter for receiving a message from one of the broadcast receiving electronic devices; and a control circuit for adding the message to the broadcast.

According to one embodiment of the interactive broadcasting system, the broadcast is an FM broadcast in accordance with radio data system (RDS).

According to one embodiment of the interactive broadcasting system, the local wireless interface adapter is one of a Bluetooth interface or a network interface.

According to one embodiment, the interactive broadcasting system further includes a radio circuit for establishing a call via a communications network.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto.

Features that are described and/or illustrated with respect to one embodiment may be used in the same way or in a similar way in one or more other embodiments and/or in combination with or instead of the features of the other embodiments.

It should be emphasized that the terms "comprises" and "comprising," when used in this specification, are taken to specify the presence of stated features, integers, steps or components but do not preclude the presence or addition of one or more other features, integers, steps, components or groups thereof.

BRIEF DESCRIPTION OF THE DRAWINGS

FIG. 1 is a schematic view of an exemplary interactive broadcasting system in accordance with an embodiment of the present invention;

FIG. 2 is a schematic block diagram a mobile telephone that represents an exemplary electronic device that may form part of the system of FIG. 1;

DETAILED DESCRIPTION OF EMBODIMENTS

Figure 3:
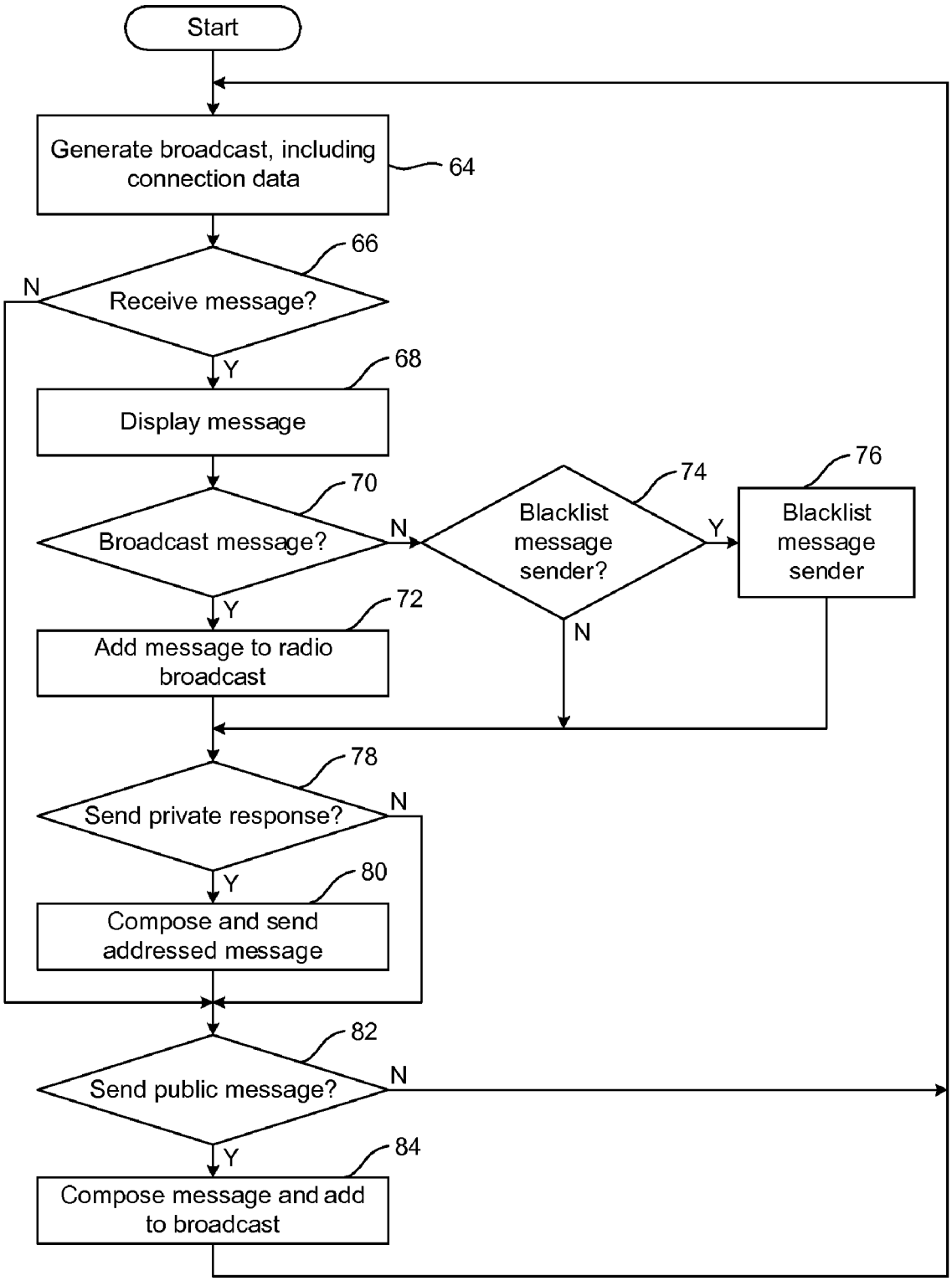
FIG. 3 is a flow chart representing an exemplary method of interactive broadcasting using the mobile telephone of FIG. 2.

Embodiments of the present invention will now be described with reference to the drawings, wherein like reference numerals are used to refer to like elements throughout. It will be understood that the figures are not necessarily to scale.

The interchangeable terms "electronic equipment" and "electronic device" include portable radio communication equipment. The term "portable radio communication equipment," which herein after is referred to as a "mobile radio terminal," includes all equipment such as mobile telephones, pagers, communicators, electronic organizers, personal digital assistants (PDAs), smartphones, portable communication apparatus or the like.

In the present application, the invention is described primarily in the context of a mobile telephone. However, it will be appreciated that the invention is not intended to be limited to the context of a mobile telephone and may relate to any type of appropriate electronic equipment, examples of which include a media player, a gaming device and a computer.

Referring initially to FIG. 1, an exemplary system 10 for establishing an interactive broadcasting platform (e.g., a "chat" channel) is illustrated. The system 10 may include an electronic device, such as the illustrated mobile telephone 12, that is configured to broadcast data for reception by compatible receivers. The receivers may be integrated into other electronic devices, such as the illustrated mobile telephones 14. The illustration of mobile telephones for the transmitting device and the receiving devices is for exemplary purposes. Other types of devices may be configured to operate in the system 10 in a similar manner and may replace the mobile telephones. Also, a mix of mobile telephones and other types of electronic devices may form with system 10.

The mobile telephone 12 may be configured to operate as part of a communications system 16. The system 16 may include a communications network 18 having a server 20 (or servers) for managing calls placed by and destined to the mobile telephone 12, transmitting data to the mobile telephone 12 and carrying out any other support functions. The server 20 communicates with the mobile telephone 12 via a transmission medium. The transmission medium may be any appropriate device or assembly, including, for example, a communications tower (e.g., a cell tower), another mobile telephone, a wireless access point, a satellite, etc. Portions of the network may include wireless transmission pathways. The network 18 may support the communications activity of multiple mobile telephones, such as one or more of the mobile telephones 14. The communications network 18 may be managed and operated by a service provider. One or more of the mobile telephones 14 may subscribe to the services of another service provider that manages and operates another communications network 22, which includes a server 24. The networks 18 and 22 may be operatively arranged so that a call may be established between mobile telephones serviced by the respective networks and/or so that data (e.g., text messages) may be exchanged between mobile telephones serviced by the respective networks. Additional communications networks may be present to service additional mobile telephones 14 or other devices. It will be appreciated that the networks 18 and 22 may be typical mobile telephone support networks that interface with mobile devices under a protocol such as code division multiple access (CDMA) or global system for mobile communications (GSM), or may be some other type of network, such as a WiFi network operating under IEEE standard 802.11 or a WiMax network operating under IEEE 802.16.

As will be described in greater detail below, local communication interfaces may be established between and among the mobile telephones 12 and 14. For instance, Bluetooth may be used to send and receive addressed data (e.g., text messages and/or voice data) between any two of the mobile telephones 12 and 14. It will be understood that addressed data is configured for network delivery to a particular device (e.g., the addressed device) and/or for access by the particular device. Other ways of exchanging addressed data may exist. For instance, addressed data may be transmitted via one or more networks (e.g., the communications network 18 and/or the communications network 22).

With additional reference to FIG. 2, illustrated is a schematic block diagram of a typical mobile telephone 12, 14 that may operate in the system 10. The block diagram of FIG. 2 may represent either a radio broadcasting device (e.g., the mobile telephone 12 of FIG. 1) or a radio receiving device (e.g., the mobile telephone 14 of FIG. 1) as the configuration of these devices may be the same. Thus, in the illustrated configuration, the device may be used as the broadcasting device or the receiving device, depending on how the user interacts and/or configures the device. Modifications to the schematic block diagram to represent a device other than a mobile telephone and/or to have the capacity to function as just one of the broadcasting device or the receiving device will be apparent to one of ordinary skill in the art.

The mobile telephone 12, 14 includes a broadcast interaction function 26 that is configured to facilitate the exchange of data with another mobile telephone 12, 14. Details and operation of the broadcast interaction function 26 will be described in greater detail below. The broadcast interaction function 26 may be embodied as executable code that is resident in and executed by the mobile telephone 12, 14. In one embodiment, the broadcast interaction function 26 may be a program stored on a computer or machine readable medium. The broadcast interaction function 26 may be a stand-alone software application or form a part of a software application that carries out additional tasks related to the mobile telephone 12, 14.

The mobile telephone 12, 14 may include a display 28. The display 28 displays information to a user such as operating state, time, telephone numbers, contact information, various navigational menus, etc., which enable the user to utilize the various features of the mobile telephone 12, 14. The display 28 also may be used to visually display content received by the mobile telephone 12, 14 and/or retrieved from a memory 30. The display 28 may be used to present text, images, video and other graphics to the user, such as photographs, mobile television content and video associated with games.

A keypad 32 provides for a variety of user input operations. For example, the keypad 32 typically includes alphanumeric keys for allowing entry of alphanumeric information such as telephone numbers, phone lists, contact information, notes, text, etc. In addition, the keypad 32 typically includes special function keys such as a "call send" key for initiating or answering a call, and a "call end" key for ending or "hanging up" a call. Special function keys also may include menu navigation and select keys to facilitate navigating through a menu displayed on the display 28. Special function keys may include audiovisual content playback keys to start, stop and pause playback, skip or repeat tracks, and so forth. Other keys associated with the mobile telephone may include a volume key, an audio mute key, an on/off power key, a web browser launch key, a camera key, etc. Keys or key-like functionality also may be embodied as a touch screen associated with the display 28. Also, the display 28 and keypad 32 may be used in conjunction with one another to implement soft key functionality.

The mobile telephone 12, 14 includes call circuitry that enables the mobile telephone 12, 14 to establish a call and/or exchange signals with a called/calling device, typically another mobile telephone or landline telephone. However, the called/calling device need not be another telephone, but may be some other device such as an Internet web server, content providing server, etc. Calls may take any suitable form. For example, the call could be a conventional call that is established over a cellular circuit-switched network or a voice over Internet Protocol (VoIP) call that is established over a packet-switched capability of a cellular network or over an alternative packet-switched network, such as WiFi, WiMax, etc. Another example includes a video enabled call that is established over a cellular or alternative network.

The mobile telephone 12, 14 may be configured to transmit, receive and/or process data, such as text messages (e.g., commonly referred to by some as "an SMS," which stands for simple message service), electronic mail messages, multimedia messages (e.g., commonly referred to by some as "an MMS," which stands for multimedia message service), instant messages, image files, video files, audio files, ring tones, streaming audio, streaming video, data feeds (including podcasts) and so forth. Processing such data may include storing the data in the memory 30, executing applications to allow user interaction with data, displaying text, video and/or image content associated with the data, outputting audio sounds associated with the data and so forth.

The mobile telephone 12, 14 includes a primary control circuit 34 that is configured to carry out overall control of the functions and operations of the mobile telephone 12, 14. The control circuit 34 may include a processing device 36, such as a CPU, microcontroller or microprocessor. The processing device 36 executes code stored in a memory (not shown) within the control circuit 34 and/or in a separate memory, such as the memory 30, in order to carry out operation of the mobile telephone 12, 14. The memory 30 may be, for example, one or more of a buffer, a flash memory, a hard drive, a removable media, a volatile memory, a non-volatile memory or other suitable device.

In addition, the processing device 36 may execute code that implements the broadcast interaction function 26. It will be apparent to a person having ordinary skill in the art of computer programming, and specifically in application programming for mobile telephones or other electronic devices, how to program a mobile telephone 12, 14 to operate and carry out logical functions associated with the broadcast interaction function 26. Accordingly, details as to specific programming code have been left out for the sake of brevity. Also, while the broadcast interaction function 26 is executed by the processing device 36 in accordance with a preferred embodiment of the invention, such functionality could also be carried out via dedicated hardware, firmware, software, or combinations thereof, without departing from the scope of the invention.

Continuing to refer to FIG. 2, the mobile telephone 12, 14 includes an antenna 38 coupled to a radio circuit 40. The radio circuit 40 includes a radio frequency transmitter and receiver for transmitting and receiving signals via the antenna 38 as is conventional. The radio circuit 40 may be configured to operate in a mobile communications system (e.g., the system 16) and may be used to send and receive data and/or audiovisual content. Receiver types for interaction with a mobile radio network and/or broadcasting network include, but are not limited to, GSM, CDMA, WCDMA, GPRS, MBMS, WiFi, WiMax, DVB-H, ISDB-T, etc., as well as advanced versions of these standards.

The mobile telephone 12, 14 further includes a sound signal processing circuit 42 for processing audio signals transmitted by and received from the radio circuit 40. Coupled to the sound processing circuit 42 are a speaker 44 and a microphone 46 that enable a user to listen and speak via the mobile telephone 12, 14 as is conventional. The radio circuit 40 and sound processing circuit 42 are each coupled to the control circuit 34 so as to carry out overall operation. Audio data may be passed from the control circuit 34 to the sound signal processing circuit 42 for playback to the user. The audio data may include, for example, audio data from an audio file stored by the memory 30 and retrieved by the control circuit 34, or received audio data such as in the form of streaming audio data from a mobile radio service. The sound processing circuit 42 may include any appropriate buffers, decoders, amplifiers and so forth.

The display 28 may be coupled to the control circuit 34 by a video processing circuit 48 that converts video data to a video signal used to drive the display 28. The video processing circuit 48 may include any appropriate buffers, decoders, video data processors and so forth. The video data may be generated by the control circuit 34, retrieved from a video file that is stored in the memory 30, derived from an incoming video data stream received by the radio circuit 40 or obtained by any other suitable method.

The mobile telephone 12, 14 may further include one or more I/O interface(s) 50. The I/O interface(s) 50 may be in the form of typical mobile telephone I/O interfaces and may include one or more electrical connectors. As is typical, the I/O interface(s) 50 may be used to couple the mobile telephone 12, 14 to a battery charger to charge a battery of a power supply unit (PSU) 52 associated with the mobile telephone 12, 14. In addition, or in the alternative, the I/O interface(s) 50 may serve to connect the mobile telephone 12, 14 to a headset assembly (e.g., a personal handsfree (PHF) device) that has a wired interface with the mobile telephone 12, 14. Further, the I/O interface(s) 50 may serve to connect the mobile telephone 12, 14 to a personal computer or other device via a data cable for the exchange of data. The mobile telephone 12, 14 may receive operating power via the I/O interface(s) 50 when connected to a vehicle power adapter or an electricity outlet power adapter.

The mobile telephone 12, 14 also may include a timer 54 for carrying out timing functions. Such functions may include timing the durations of calls, generating the content of time and date stamps, etc. The mobile telephone 12, 14 may include a camera 56 for taking digital pictures and/or movies. Image and/or video files corresponding to the pictures and/or movies may be stored in the memory 30. The mobile telephone 12, 14 also may include a position data receiver 58, such as a global positioning system (GPS) receiver, Galileo satellite system receiver or the like.

The mobile telephone 12, 14 also may include a local wireless interface 60, such as an infrared transceiver and/or an RF adaptor (e.g., a Bluetooth transceiver), for establishing communication with an accessory, another mobile radio terminal, a computer or another device. For example, the local wireless interface 60 may operatively couple the mobile telephone 12, 14 to a headset assembly (e.g., a PHF device) in an embodiment where the headset assembly has a corresponding wireless interface.

The mobile telephone 12, 14 also may include a broadcast transceiver 62. The broadcast transceiver 62 may be capable of generating FM broadcasts under RDS, for example, or any other appropriate broadcast or signal transmission that is not addressed to a particular device or devices. In the case of the mobile telephone 12, the broadcast transceiver 62 includes at least a transmitter to transmit signals and also may include a receiver for receiving signals transmitted by another device. In the case of the mobile telephone 14, the broadcast transceiver 62 includes at least a receiver to receive signals broadcast by the broadcast transceiver 62 of the mobile telephone 12 and also may include a transmitter to transmit signals. In the illustrated embodiment, the broadcast transceiver 62 is an integral part of the mobile telephone 12, 14. In other embodiments, the broadcast transceiver 62 may be an accessory that is operatively interfaced with the mobile telephone 12, 14, such as via the I/O interface 50.

With additional reference to FIG. 3, illustrated are logical operations to implement an exemplary method of interactive broadcasting. The exemplary method may be carried out by executing an embodiment of the broadcast interaction function 26 with the mobile telephone 12, for example. Thus, the flow chart of FIG. 3 may be thought of as depicting steps of a method carried out by the mobile telephone 12. Although FIG. 3 shows a specific order of executing functional logic blocks, the order of executing the blocks may be changed relative to the order shown. Also, two or more blocks shown in succession may be executed concurrently or with partial concurrence. Certain blocks also may be omitted. In addition, any number of functions, logical operations, commands, state variables, semaphores or messages may be added to the logical flow for purposes of enhanced utility, accounting, performance, measurement, troubleshooting, and the like. It is understood that all such variations are within the scope of the present invention.

The flow chart of FIG. 3 includes functional blocks to broadcast content to devices that have a compatible receiver. Also, functional blocks combine to receive and broadcast messages from other devices. The messages may be displayed for prescreening before being broadcast. Functional blocks allow for messages from a particular device to be blocked or "blacklisted." Functional blocks are present to allow for a private message to be addressed to another device and/or for public messages to broadcast. It will be appreciated, that these functions will be described as being part of a logical order stemming from the flow chart. However, in implementation, some or all of these function may be "turned-on", "turned-off", carried out or omitted based on operating state (e.g., as set through the execution of object-oriented programming) and/or based on user action, such as preference settings and/or menu selection. For example, the display of messages for prescreening may be turned off in favor of automatic broadcasting of incoming messages.

In the embodiment described in connection with the flowchart of FIG. 3, text messages are exchanged to establish an interactive platform in connection with the broadcast of content from the mobile telephone 12. One of ordinary skill in the art will appreciate that text messages may be replaced with or supplemented by audio and/or video content, such as voice conversations. The interactive platform allows users to "chat" about the broadcast content or about other topics of interest to the users of the mobile telephones 12 and/or 14.

The broadcast of the illustrated embodiment is a radio broadcast, such as an FM broadcast under the RDS standard. Other types of broadcasts that are not addressed to a specific electronic device or devices are possible and fall within the Applicant's use of the term broadcast. For example, amplitude modulation (AM) radio broadcasts, very high frequency (VHF) broadcasts and/or ultra high frequency (UHF) broadcasts could be used. The content transmitted as part of the broadcast may include any type of audiovisual content. The term "audiovisual content" broadly refers to any type of audio-based and/or video-based subject matter and may include, for example, text (e.g., a collection of alphanumeric characters), images, music, audio, speech, video, and combinations of these content types.

The logical flow for the broadcast interaction function 26 may begin in block 64 where the mobile telephone 12 generates a broadcast by transmitting a signal with the broadcast transceiver 62 for reception by transceivers 62 of mobile telephones 14 that are within the transmission range of the mobile telephone 12. Using current FM broadcast technology that broadcasts within governmental regulations, the transmission range may be about twenty to about thirty meters. If the broadcasting mobile telephone 12 were in the presence of receiving mobile telephones 14, there may be one or more users who may be interested in tuning to the broadcast of the mobile telephone 12 and sharing comments with the user of the mobile telephone 12 and/or other persons who have tuned to the broadcast. Such a situation may arise on a train, bus or plane (or while waiting to board one of these modes of transportation), in a school environment, in an urban environment, in a shopping area, and so forth. The broadcast of block 64 may be, for example, an RDS broadcast.

Included in the broadcast may be connection data for establishing an interface with the mobile telephone 12 (e.g., a Bluetooth interface or other network session) and/or addressing a message to the mobile telephone 12 for delivery over a local interface or through a network (e.g., the network 18). In one embodiment, the connection data is a Bluetooth address (e.g., a unique address for the local wireless interface 60 of the mobile telephone 12) or a Bluetooth identification name (e.g., a name given to the mobile telephone 12 by the user of the mobile telephone 12). Other types of connection data may be used for other types of devices and/or message delivery techniques. Other examples of connection data may include, an internet protocol (IP) address, a subscriber identity, a telephone number, a network address, a user name, a device name, radio station ID, and so forth.

Thereafter, in block 66, a determination may be made as to whether the mobile telephone 12 has received a message from one of the mobile telephones 14 that is tuned to the broadcast. In one embodiment, the message is addressed to the mobile telephone 12. The transmission of a message to the mobile telephone 12 by one of the mobile telephone 14 that is tuned to the broadcast is described below in connection with FIGS. 4 and 5. In one embodiment, the message is a text-based message that is pushed to the mobile telephone 12. The message may take any suitable form, such as an instant message, a text message (e.g., SMS), a multimedia message (e.g., an MMS), an electronic mail message, or any other suitable format. In addition to text, it is contemplated that the message may include other forms of audiovisual content, such as images, audio and/or video.

If a positive determination is made in block 66, the logical flow may proceed to block 68 where the message is displayed to the user of the mobile telephone 12 for review. In block 70, the user of the mobile telephone 12 may elect to broadcast the message as part of the broadcast. If a positive determination is made in block 70, the message may be added to the broadcast in block 72 for receipt by the mobile telephones 14 that are tuned to the broadcast. In the case of a text message, the text may be extracted and broadcast as RDS data. In the case of other content or in another embodiment for text messages, the content may be retained in its native format and transmitted in digital form as part of the broadcast signal.

If a negative determination is made in block 70, the logical flow may proceed to block 74 where the user of the mobile telephone 12 may elect to blacklist the sender of the message. Blacklisting may be accomplished by blocking messages from the mobile telephone 14 from which the message was transmitted. The user may wish to blacklist the message sender if the sender composes inappropriate messages or otherwise abuses the interactive broadcast platform established under the techniques described herein. If a positive determination is made in block 74, the logical flow may proceed to block 76 where future messages from the sender may be blocked. The specific technique for blocking messages will depend on the delivery medium for the messages (e.g., Bluetooth, network delivery, etc.). In another embodiment, messages from the send may not be blocked, but may simply be ignored (e.g., not displayed in block 68 and/or broadcast in block 72).

Following a negative determination in block 74 or after blocks 72 or 76, the logical flow may proceed to block 78. In block 78, a determination may be made as to whether the user of the mobile telephone 12 would like to send a private response back to the sender of the message that was received in block 66. If a positive determination is made in block 78, the logical flow may proceed to block 80 where the user composes the reply message and sends the reply message in a manner that is addressed to the mobile telephone 14 from which the message received in block 66 was sent. In one embodiment, the reply message may be a text-based message and may take any suitable form, such as an instant message, a text message (e.g., SMS), a multimedia message (e.g., an MMS), an electronic mail message, or any other suitable format. In addition to text, it is contemplated that the reply message may include other forms of audiovisual content, such as images, audio and/or video.

Following block 80 or following a negative determination in block 78 or block 66, the logical flow may proceed to block 82. In block 82, a determination may be made as to whether the user of the mobile telephone 12 would like to send a public message. If a positive determination is made in block 82, the logical flow may proceed to block 84 where the sender composes the public message and adds the message to the broadcast signal of block 64 for receipt by the mobile telephones 14. In one embodiment, the public message may be a text-based message and may take any suitable form, such as an instant message, a text message (e.g., SMS), a multimedia message (e.g., an MMS), an electronic mail message, or any other suitable format. In addition to text, it is contemplated that the public message may include other forms of audiovisual content, such as images, audio and/or video. Following block 84 or following a negative determination in block 82, the logical flow may return to block 64 to continue the broadcast and wait for the receipt of a message from one of the mobile telephones 14.

Figure 4:
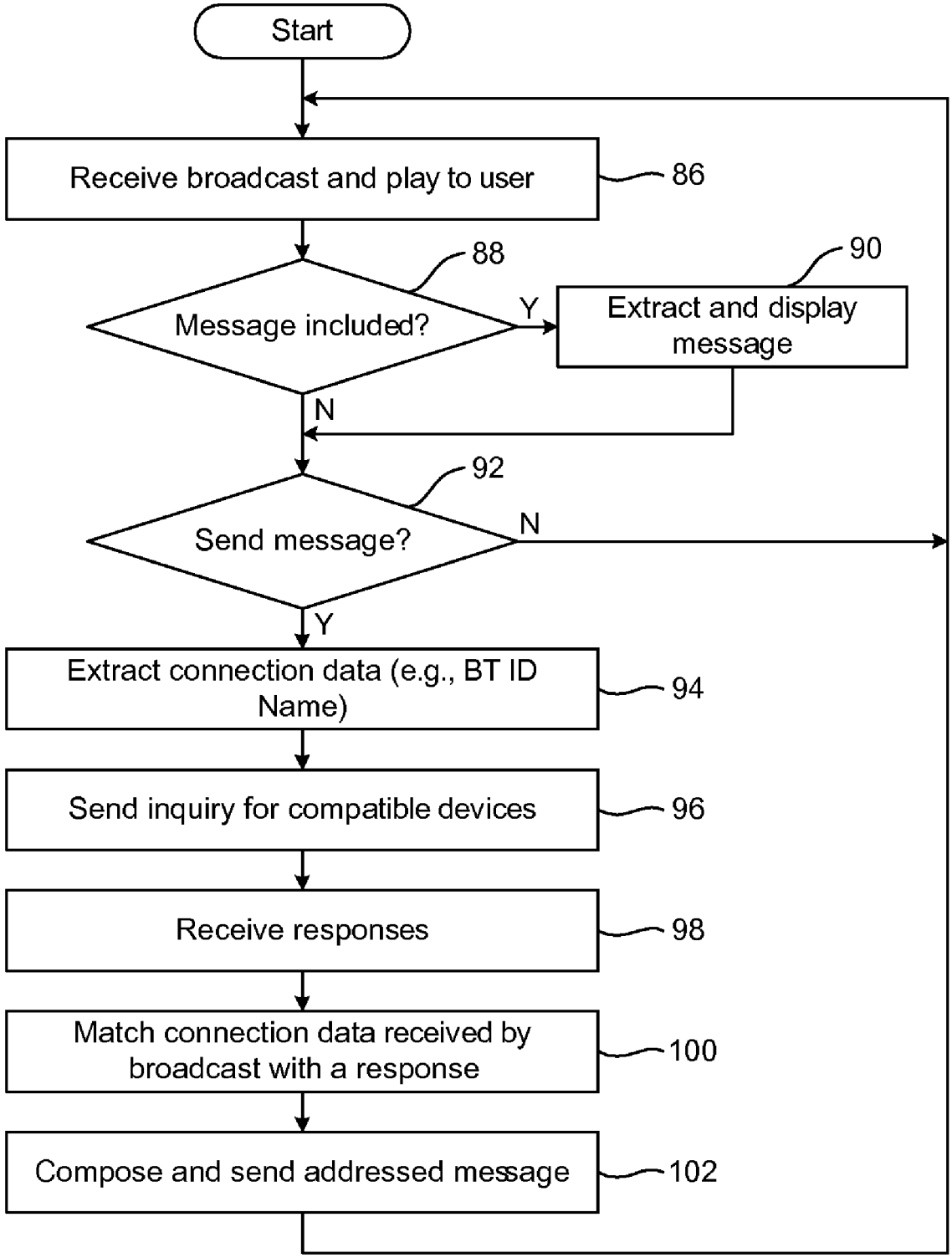
FIG. 4 is a flow chart representing an exemplary method of participating in an interactive broadcast.

With additional reference to FIG. 4, illustrated are logical operations to implement an exemplary method of interactive broadcasting that is in conjunction with interactive broadcast operations carried out by the mobile telephone 12 (e.g., the operations illustrated in FIG. 3). The exemplary method of FIG. 4 may be carried out by executing an embodiment of the broadcast interaction function 26 with the mobile telephone 14, for example. The logical flow represents a method of interactive broadcasting where the mobile telephone 14 ascertains an address of the transmitting mobile telephone 12 from connection data that takes the form of an identification name assigned to the mobile telephone 12 by the user of the mobile telephone 12.

The flow chart of FIG. 4 may be thought of as depicting steps of a method carried out by the mobile telephone 14. Although FIG. 4 shows a specific order of executing functional logic blocks, the order of executing the blocks may be changed relative to the order shown. Also, two or more blocks shown in succession may be executed concurrently or with partial concurrence. Certain blocks also may be omitted. In addition, any number of functions, logical operations, commands, state variables, semaphores or messages may be added to the logical flow for purposes of enhanced utility, accounting, performance, measurement, troubleshooting, and the like. It is understood that all such variations are within the scope of the present invention.

The logical flow for the broadcast interaction function 26 as executed by the mobile telephone 14 may begin in block 86 where the mobile telephone 14 tunes to and receives a broadcast transmitted by the mobile telephone 12. The broadcast may be decoded and output to the user in a manner appropriate for the received content. For instance, if the content that was broadcast by the mobile telephone 12 is music, a corresponding audible signal may be output by the speaker 44 or an operatively interfaced PHF device.

In block 88, a determination may be made as to whether the broadcast includes a message. If a positive determination is made in block 88, the logical flow may proceed to block 90 where the message is extracted from the received signal and displayed to the user of the mobile telephone 14.

Following block 90 or a negative determination in block 88, the logical flow may proceed to block 92 where a determination is made as to whether the user of the mobile telephone 14 would like to send a message to the mobile telephone 12. If a negative determination is made in block 92, the logical flow may return to block 86 to continue to receive the broadcast and wait for a message to be included with the broadcast.

If a positive determination is made in block 92, the logical flow may proceed to block 94. In block 94, the connection data that was broadcast with the signal from the mobile telephone 12 may be extracted. From the connection data, the mobile telephone 14 may ascertain an identifier for the mobile telephone 12. In one embodiment, the identifier may be an identification (ID) name assigned by the user of the mobile telephone 12. For instance, the identifier may be a Bluetooth ID name transmitted in Cleartext form (e.g., "Mike's mobile").

Thereafter, in block 96, the mobile telephone 14 may search for devices capable of establishing a local interface and/or otherwise communicating with the mobile telephone 14 using, for example, the local wireless interface 60 (FIG. 2). In the Bluetooth example, the mobile telephone 14 may search for other Bluetooth devices by sending a Bluetooth connection inquiry. In block 98, the mobile telephone 14 may receive responses to the inquiry of block 96. Included with the responses may be connection data for the responding devices, including user assigned identifiers and/or device addresses. In block 100, the mobile telephone may match the identifier extracted in block 94 with data that was received in block 98 to identify a corresponding device address and, hence, the device that is used as the broadcast source of the signal received in block 86. Thereafter, in block 102, the user of the mobile telephone 14 may compose a message that is addressed to the address identified in block 100 and transmit the message for receipt by the mobile telephone 12. In one embodiment, the broadcast information function 26 may populate an address field of the message with the address identified in block 100. Thereafter, the logical flow may return to block 86 to continue to receive the broadcast and wait for a message to be included with the broadcast.

Figure 5:
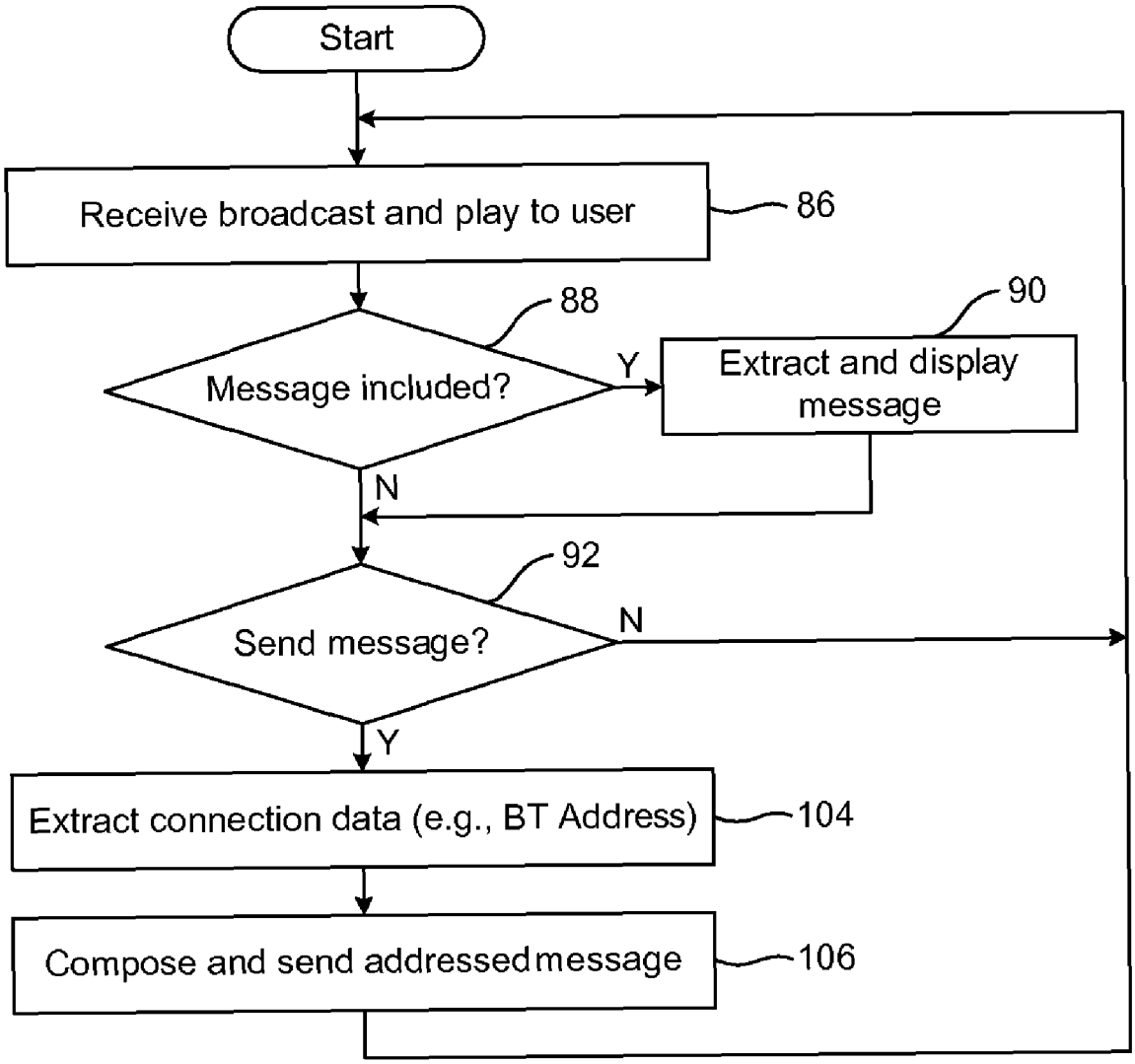
FIG. 5 is a flow chart representing another exemplary method of participating in an interactive broadcast.

With additional reference to FIG. 5, illustrated are logical operations to implement an exemplary method of interactive broadcasting that is in conjunction with interactive broadcast operations carried out by the mobile telephone 12 (e.g., the operations illustrated in FIG. 3). The exemplary method of FIG. 5 may be carried out by executing an embodiment of the broadcast interaction function 26 with the mobile telephone 14, for example. The logical flow represents a method of interactive broadcasting where the mobile telephone 14 ascertains an address of the transmitting mobile telephone 12 from connection data that forms part of the broadcast. Logical blocks that have commonality with blocks illustrated in FIG. 4 have been given the same reference numerals and the associated description will be abbreviated.

The flow chart of FIG. 5 may be thought of as depicting steps of a method carried out by the mobile telephone 14. Although FIG. 5 shows a specific order of executing functional logic blocks, the order of executing the blocks may be changed relative to the order shown. Also, two or more blocks shown in succession may be executed concurrently or with partial concurrence. Certain blocks also may be omitted. In addition, any number of functions, logical operations, commands, state variables, semaphores or messages may be added to the logical flow for purposes of enhanced utility, accounting, performance, measurement, troubleshooting, and the like. It is understood that all such variations are within the scope of the present invention.

The logical flow for the broadcast interaction function 26 as executed by the mobile telephone 14 may begin in block 86 where the mobile telephone 14 tunes to and receives a broadcast transmitted by the mobile telephone 12. The broadcast may be decoded and output to the user in a manner appropriate for the received content. In block 88, a determination may be made as to whether the broadcast includes a message. If a positive determination is made in block 88, the logical flow may proceed to block 90 where the message is extracted from the received signal and displayed to the user of the mobile telephone 14. Following block 90 or a negative determination in block 88, the logical flow may proceed to block 92 where a determination is made as to whether the user of the mobile telephone 14 would like to send a message to the mobile telephone 12. If a negative determination is made in block 92, the logical flow may return to block 86 to continue to receive the broadcast and wait for a message to be included with the broadcast.

If a positive determination in made in block 92, the logical flow may proceed to block 104. In block 104, the connection data that was broadcast with the signal from the mobile telephone 12 may be extracted. As indicated, the connection data may be an address for the mobile telephone 12. A message that is addressed to the extracted address may be deliverable to the mobile telephone 12. In one embodiment, the address may be a Bluetooth address. Thereafter, in block 106, the user of the mobile telephone 14 may compose a message that is addressed to the address identified in block 104 and transmit the message for receipt by the mobile telephone 12. In one embodiment, the broadcast information function 26 may populate an address field of the message with the extracted address. Thereafter, the logical flow may return to block 86 to continue to receive the broadcast and wait for a message to be included with the broadcast.

It will be appreciated that other addressing schemes and device identification techniques may be used in addition to or instead of the techniques described with respect to FIGS. 4 and 5.

Systems and methods for interactive broadcasting have been disclosed. In one embodiment, a Bluetooth feedback channel is established to push text messages (or other audio-visual content messages) from a device receiving a broadcast to a device transmitting the broadcast. The messages may be shared with others by including the message in the broadcast. In effect, an interactive chat is shared among various devices. The interaction provides a manner of sending feedback to a person who is broadcasting a publicly available signal. When using FM RDS functionality, the broadcaster may be considered to be generating his or her own radio station and people who are tuned to station may send feedback to the broadcaster and that feedback may be shared publicly with others over the broadcast.

Although the invention has been shown and described with respect to certain preferred embodiments, it is understood that equivalents and modifications will occur to others skilled in the art upon the reading and understanding of the specification. The present invention includes all such equivalents and modifications, and is limited only by the scope of the following claims.

What is claimed is:

1. A method of interactive broadcasting, comprising:

transmitting an FM broadcast with a broadcast transceiver associated with a broadcast transmitting electronic device, the broadcast for reception by one or more broadcast receiving electronic devices that have compatible receivers and that are within a transmission range of the broadcast transceiver, wherein the broadcast includes audio-based subject matter and connection data for at least one of establishing a communications interface with the broadcast transmitting electronic device or addressing a message to the broadcast transmitting electronic device;

receiving a message from one of the broadcast receiving electronic devices, wherein said message is a text message, that is tuned to the broadcast;

displaying the message to a user of the broadcast transmitting electronic device for review; and determining if the user elects to include the message as part of the broadcast and, if so, adding the message to the broadcast for receipt by the broadcast receiving electronic devices that are tuned to the broadcast, the adding of the message establishing interactive commentary among users of the broadcast receiving electronic devices and the user of the broadcast transmitting electronic device.

2. The method of claim 1, wherein the message is pushed to the broadcast transmitting electronic device.

3. The method of claim 1, wherein the message is addressed to the broadcast transmitting electronic device.

4. The method of claim 3, further comprising sending a reply message that is addressed to the broadcast receiving electronic device that is the source of the message.

5. The method of claim 3, wherein the message is delivered via a network.

6. The method of claim 1, wherein the message is delivered via a local interface established directly between the broadcast transmitting electronic device and the broadcast receiving electronic device.

7. The method of claim 1, wherein the FM broadcast is in accordance with radio data system (RDS).

8. The method of claim 1, wherein the broadcast transmitting electronic device is a mobile telephone.

9. The method of claim 1, wherein the broadcast receiving electronic device from which the message is received is a mobile telephone.

10. The method of claim 1, further comprising adding a message that is generated by a user of the broadcast transmitting electronic device to the broadcast.

11. The method of claim 1, further comprising receiving a message from another one of the broadcast receiving electronic devices and blocking the broadcast of the message and future messages from the another one of the broadcast receiving electronic devices.

12. A method of participating in an interactive broadcast using an electronic device, comprising:

tuning to and receiving an FM broadcast signal transmitted by a broadcast transmitting electronic device, the broadcast signal including audio-based subject matter and connection data for at least one of establishing a communications interface with the broadcast transmitting electronic device or addressing a message to the broadcast transmitting electronic device;

decoding the audio-based subject matter and outputting a corresponding audio signal to a user of the electronic device;

detecting in the broadcast signal a message originating from another electronic device that is tuned to the broadcast signal and that was added to the broadcast signal by the broadcasting electronic device, extracting the message, and displaying the message to the user of the electronic device;

detecting if the user of the electronic device elects to send a message to the broadcasting electronic device and, if so, determining a device address for the broadcast transmitting electronic device from the broadcast signal and sending an addressed message to the broadcast transmitting electronic device for addition to the broadcast; and continuing to receive the broadcast signal including the sent message, wherein said sent message is a text message, if a user elects to include said sent message as part of the broadcast, the receipt and displaying of messages from the broadcast signal establishing interactive commentary among users of the electronic devices that are tuned to the broadcast signal and a user of the broadcasting electronic device.

13. The method of claim 12, wherein the sent message is sent over a local interface established directly with the broadcast transmitting electronic device.

14. The method of claim 12, wherein the electronic device is a mobile telephone.

15. An interactive broadcasting system, comprising:

a broadcast transceiver for transmitting an FM broadcast for reception by one or more broadcast receiving electronic devices that have compatible receivers and that are within a transmission range of the broadcast transceiver, wherein the broadcast includes audio-based subject matter and connection data for at least one of establishing a communications interface with the broadcast transmitting electronic device or addressing a message to the broadcast transmitting electronic device;

a local wireless interface adapter for receiving a message, wherein said message is a text message, from one of the broadcast receiving electronic devices that is tuned to the broadcast;

a display; and a control circuit configured to:

drive the display to display the message to a user of the interactive broadcasting system; and determine if the user elects to include the message as part of the broadcast and, if so, add the message to the broadcast for receipt by the broadcast receiving electronic devices that are tuned to the broadcast, the adding of the message establishing interactive commentary among users of the broadcast receiving electronic devices and the user of the broadcast transmitting electronic device.

16. The interactive broadcasting system of claim 15, wherein the FM broadcast is in accordance with radio data system (RDS).

17. The interactive broadcasting system of claim 15, wherein the local wireless interface adapter is one of a Bluetooth interface or a network interface.

18. The interactive broadcasting system of claim 15, further comprising a radio circuit for establishing a call via a communications network.

* * * * *